US009109803B2

(12) United States Patent
Motabar et al.

(10) Patent No.: US 9,109,803 B2
(45) Date of Patent: Aug. 18, 2015

(54) COOKTOP APPLIANCE WITH FEATURES FOR IMPROVING ILLUMINATION

(75) Inventors: Payam Motabar, Louisville, KY (US); Paul Bryan Cadima, Prospect, KY (US); Justin Tyler Brown, Louisville, KY (US)

(73) Assignee: General Electric Company, Schenectady, NY (US)

( * ) Notice: Subject to any disclaimer, the term of this patent is extended or adjusted under 35 U.S.C. 154(b) by 647 days.

(21) Appl. No.: 13/406,578

(22) Filed: Feb. 28, 2012

(65) Prior Publication Data

US 2013/0220298 A1 Aug. 29, 2013

(51) Int. Cl.

| | |
|---|---|
| ***H05B 3/68*** | (2006.01) |
| ***F24C 15/10*** | (2006.01) |
| ***F24C 7/08*** | (2006.01) |

(52) U.S. Cl.

CPC ..... *F24C 15/10* (2013.01); *F24C 7/082* (2013.01); *F24C 7/083* (2013.01)

(58) Field of Classification Search

CPC ..... F24C 7/08–7/083; F24C 15/10
USPC ..... 219/443.1–468.2; 126/213
See application file for complete search history.

(56) References Cited

U.S. PATENT DOCUMENTS

| | | | | |
|---|---|---|---|---|
| 2,346,237 | A * | 4/1944 | Rutenber | 219/445.1 |
| 2,450,399 | A * | 9/1948 | Sheidler | 219/445.1 |
| 2,870,316 | A * | 1/1959 | Ferguson, Jr. | 219/445.1 |
| 4,990,750 | A * | 2/1991 | Martel et al. | 219/445.1 |
| 5,046,477 | A * | 9/1991 | Bennett et al. | 126/39 B |
| 6,218,679 | B1 * | 4/2001 | Takahara et al. | 257/59 |
| 6,505,621 | B2 * | 1/2003 | Gabelmann | 126/39 R |
| 6,639,190 | B2 | 10/2003 | Lerner | |
| 6,794,621 | B1 * | 9/2004 | Brown et al. | 219/506 |
| 6,806,444 | B2 | 10/2004 | Lerner | |
| 6,892,485 | B2 * | 5/2005 | Geyer | 40/541 |
| 7,087,865 | B2 | 8/2006 | Lerner | |
| 7,173,221 | B2 | 2/2007 | Lerner | |
| 7,554,060 | B2 | 6/2009 | England et al. | |
| 7,763,832 | B2 * | 7/2010 | Striegler et al. | 219/448.11 |

* cited by examiner

*Primary Examiner* — Sang Y Paik
(74) *Attorney, Agent, or Firm* — Dority & Manning, P.A.

(57) ABSTRACT

A cooktop appliance is provided with features for directing light from a light source through a cooking surface of the appliance. The light source may be positioned below the cooking surface, and the features may be positioned adjacent the cooking surface such that the features direct light from the light source through the cooking surface. As a result, the visibility of light to a user of the appliance can be improved.

20 Claims, 3 Drawing Sheets

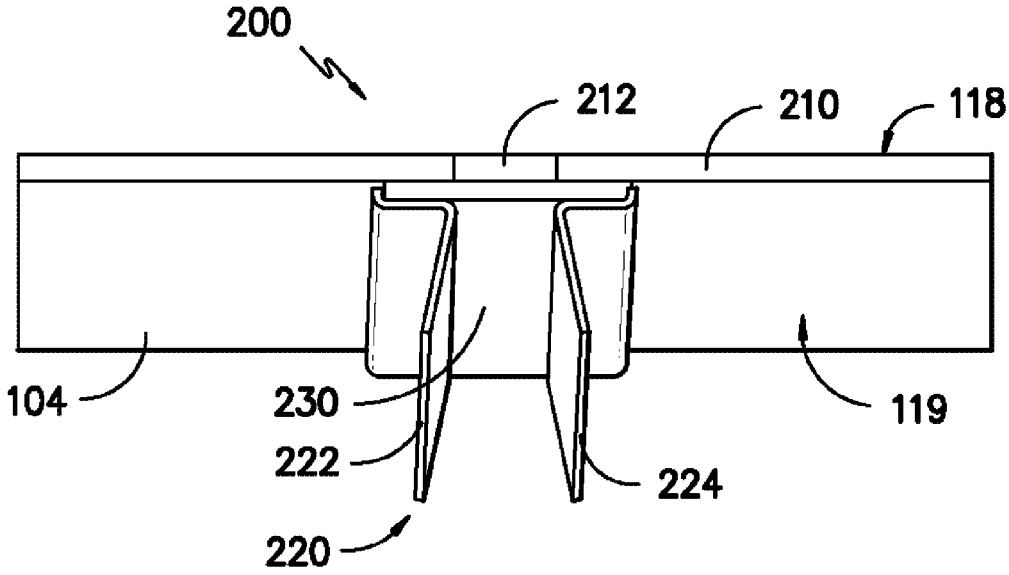
FIG. –2–
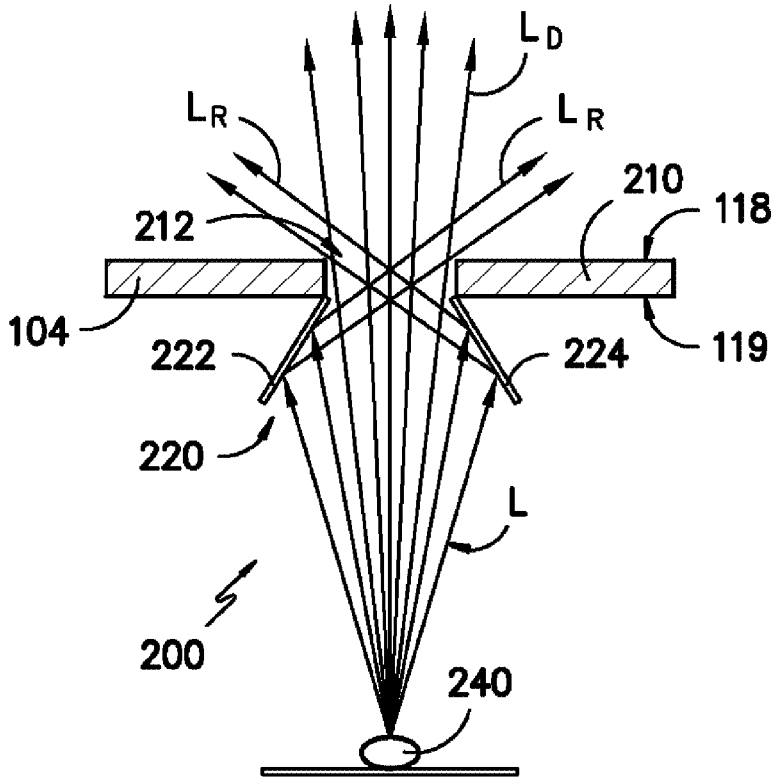
FIG. –3–

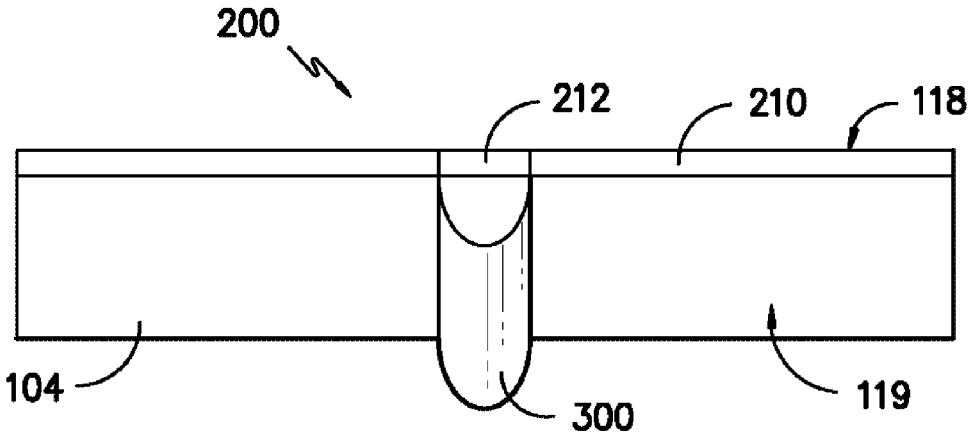
FIG. –4–
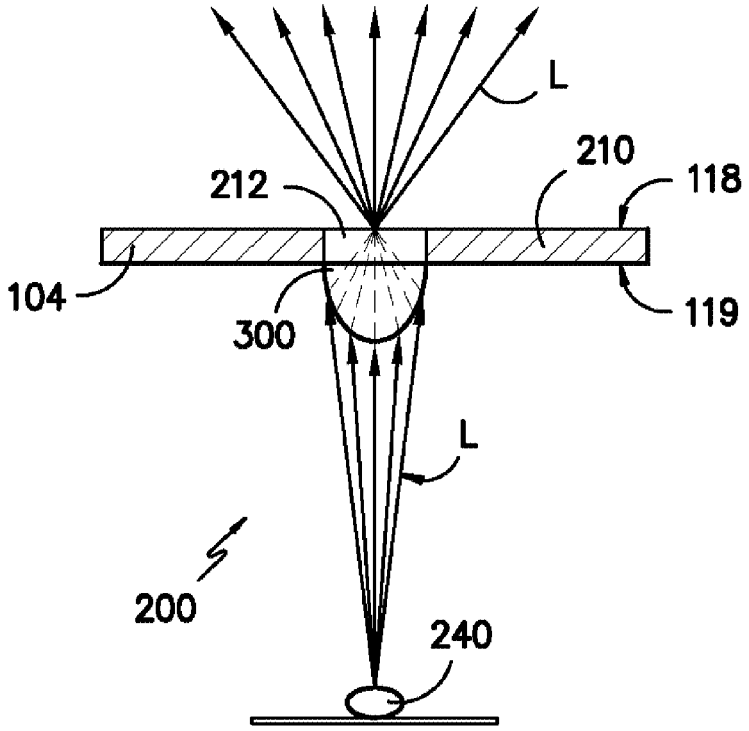
FIG. –5–

COOKTOP APPLIANCE WITH FEATURES FOR IMPROVING ILLUMINATION

FIELD OF THE INVENTION

The present subject matter relates generally to cooktop appliances with features for directing light from a light source through a cooking surface of the appliance.

BACKGROUND OF THE INVENTION

Generally, cooktop appliances include a cooking surface that is configured for supporting cooking utensils. A heating source supplies thermal energy to the cooking utensils supported by the cooking surface. The cooktop appliance can also include a light source. The light source can provide light for assisting a user, e.g., by illuminating the cooking surface, by providing a visual indicator for certain features of the appliance, and/or by providing aesthetic appeal.

The light source can be mounted within the cooktop appliance below the cooking surface. However, the cooking surface is generally opaque. Thus, when the light source is mounted below the cooking surface, the cooking surface can have a transparent or translucent portion that permits light from the light source to pass through the cooking surface to the user.

Generally, only a small portion of the light emitted by the light source passes through the cooking surface. The remainder is absorbed and/or reflected within the appliance below the cooking surface. Thus, a user may see only a small portion of the amount of light emitted by the light source. As noted above, the light source can provide several important functions. However, when only a small portion of the light emitted from the light source reaches a user, the ability of the light source to perform these functions can be limited.

Accordingly, a cooktop appliance with features for directing light from a light source through a transparent or translucent portion of the appliance's cooking surface would be useful.

Also, the light source is generally spaced apart from the cooking surface and positioned directly below the transparent or translucent portion of the cooking surface. Thus, the light source can be best viewed directly above the transparent or translucent portion. However, a user is typically not positioned directly above the transparent or translucent portion and, thus, is generally not positioned to best view light emitted by the light source.

Accordingly, a cooktop appliance with features for directing light in a manner more visible to a user would be useful.

BRIEF DESCRIPTION OF THE INVENTION

Aspects and advantages of the invention will be set forth in part in the following description, or may be obvious from the description, or may be learned through practice of the invention.

In a first embodiment, a cooktop appliance is provided. The cooktop appliance includes a heating source for applying a heat input to a cooking utensil. A cooking surface is configured for supporting the cooking utensil. The cooking surface has a top and bottom. The cooking surface includes an opaque portion and a transparent or translucent portion. A light source is positioned below the transparent or translucent portion of the cooking surface. A means for directing light from said light source towards the transparent or translucent portion of said cooking surface is also provided.

In a second embodiment, a cooktop appliance is provided. The cooktop appliance includes a heating source for applying a heat input to a cooking utensil. A cooking surface is configured for supporting the cooking utensil. The cooking surface has a top and bottom. The cooking surface defines an aperture for permitting transmission of light through the cooking surface. A light source is positioned below the aperture. A means for directing light from said light source towards the aperture is also provided.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 2 illustrates a perspective and partial cross-sectional view of an exemplary cooking surface of the cooktop appliance of FIG. 1 and, in particular, an exemplary reflector mounted to the bottom of the cooking surface.

FIG. 3 provides a schematic and cross-sectional view of the cooking surface of FIG. 2 with the reflector directing light from an exemplary light source through the cooking surface.

FIG. 4 illustrates a perspective and partial cross-sectional view of the cooking surface of the cooktop appliance of FIG. 1 and, in particular, an exemplary lens mounted to the bottom of the cooking surface.

FIG. 5 provides a schematic and cross-sectional view of the cooking surface of FIG. 4 with the lens directing light from an exemplary light source through the cooking surface.

DETAILED DESCRIPTION OF THE INVENTION

Figure 1:
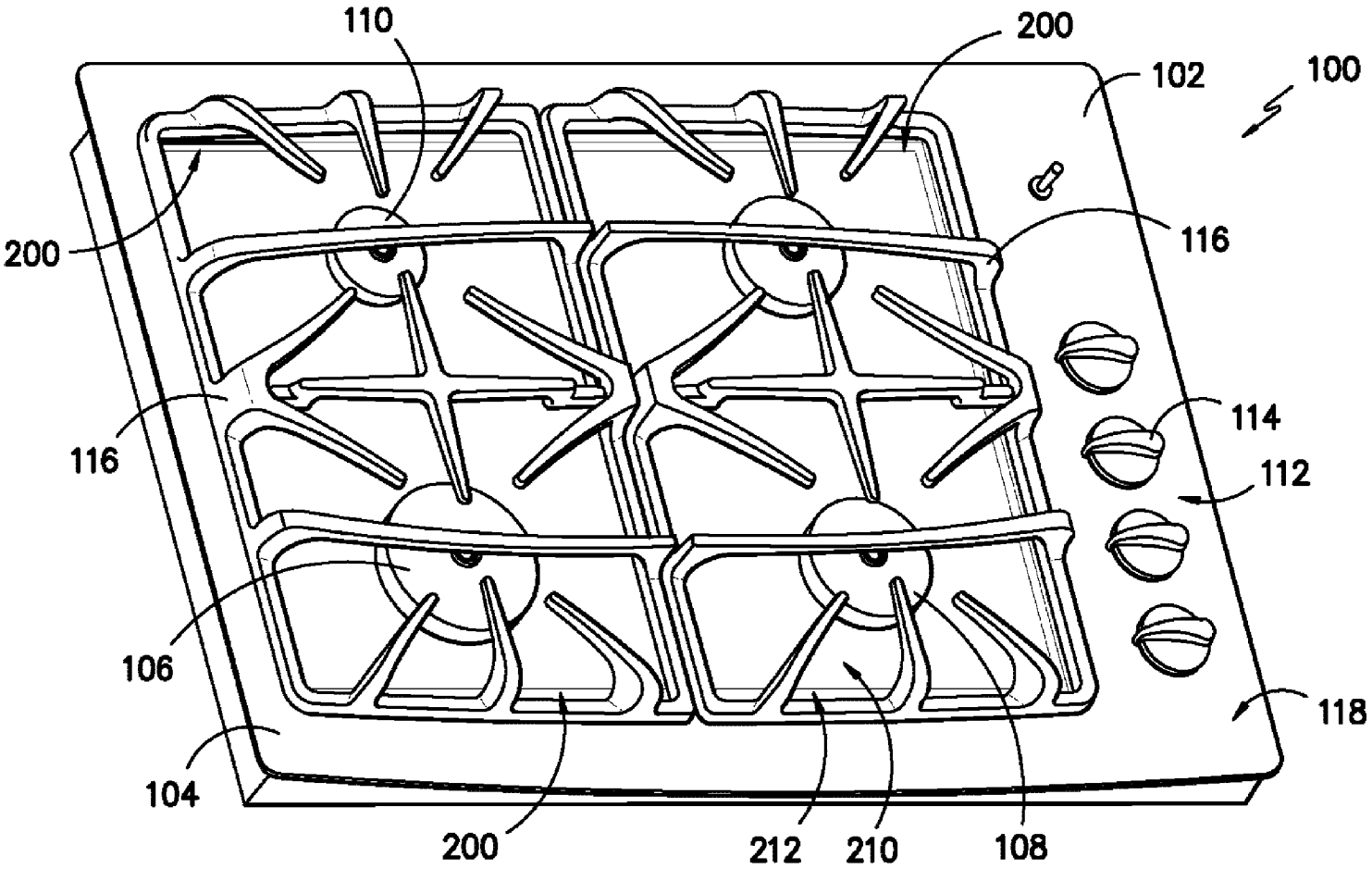
FIG. 1 provides a perspective view of a cooktop appliance according to an exemplary embodiment of the present subject matter and, in particular, illustrates an exemplary lighting assembly of the cook top appliance.

A cooktop appliance is provided with features for directing light from a light source through a cooking surface of the appliance. The light source may be positioned below the cooking surface, and the features may be positioned adjacent the cooking surface such that the features direct light from the light source through the cooking surface. As a result, the visibility of light to a user of the appliance can be improved. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 illustrates an exemplary embodiment of a cook top appliance 100 as may be employed with the present subject matter. Cook top 100 includes a non-metallic material 102 that provides a cooking surface 104. By way of example, non-metallic material 102 may be constructed from glass, ceramics, and combinations thereof.

For cook top 100, a utensil holding food and/or cooking liquids (e.g., oil, water, etc.) is placed onto grates 116 at a location of any of heating sources 106, 108, 110. Heat elements 106, 108, 110 can be configured in various sizes as shown so as to provide e.g., for the receipt of cooking utensils (i.e., pots, pans, etc.) of various sizes and configurations and to provide different heat inputs for such cooking utensils. Grates 116 are supported on a top 118 of cooking surface 104. As will be understood by those skilled in the art, in alternative embodiments, utensils holding food and/or cooking liquids may be placed directly onto the cooking surface 104 at a location of any of heating sources 106, 108, 110. Thus, utensils may rest directly on top 118 of cooking surface 104, e.g., when heating sources 106, 108, 110 are disposed beneath cooking surface 104.

Heating sources 106, 108, 110 provide thermal energy to cooking utensils on grates 116. As will be understood by those skilled in the art heating sources 106, 108, 110 can have a variety of constructions. For example, heating sources 106, 108, 110 can be constructed as gas burners, electric radiant, electric induction, or gas-on-glass heating sources. In FIG. 1, heating sources 106, 108, 110 are gas burners that project through cooking surface 104. However, heating sources of different shapes, locations, and configurations other than as shown in FIG. 1 may be used as well. For example, mechanisms associated with alternative heating sources may be positioned under cooking surface 104 as will be well understood of one of skill in the art using the teachings disclosed herein.

Also, shown in FIG. 1 is a lighting assembly 200. Lighting assembly 200 is disposed within cooking surface 104 and serves as a visual indicator for certain functions of appliance 100. For example, lighting assembly 200 may activate during operation of heating sources 106, 108, 110. Thus, during operation of a particular one of heating sources 106, 108, 110, lighting assembly 200 may emit light, or, alternatively, a portion of lighting assembly 200 positioned adjacent the particular one of heating sources 106, 108, 110 may emit light. For example, lighting assembly 200 may emit red or any other suitable color light to serve as a visual indicator of cooktop appliance 100 operation. In addition, lighting assembly 200 may function as an aesthetic device to improve the appeal of cooktop appliance 100 to consumers. In additional alternative embodiments, lighting assembly 200 may serve any other suitable purpose.

It should be understood that lighting assembly 200 shown in FIG. 1 is provided by way of example only, and the configuration shown in FIG. 1 is not intended to be limiting. Thus, it will be understood by those skilled in the art that other suitable configurations may be used as well. For example, rather the single rectangular profile surrounding heating elements 106, 108, 110 shown in FIG. 1, lighting assembly 200 may have a circular profile. Alternatively, lighting assembly 200 may have multiple rectangular or circular profiles surrounding each particular heating element 106, 108, 110.

A user interface panel 112 is located within convenient reach of a user of the appliance 100. For this exemplary embodiment, panel 112 includes knobs 114 that are each associated with one of heating sources 106, 108, 110. Knobs 114 allow the user to activate each heating source and determine the amount of heat input provided by each such element 106, 108, 110 to a cooking utensil location thereon. Panel 112 may also be provided with one or more graphical display devices that deliver certain information to the user such as e.g., whether a particular heating source is activated and/or the level at which the element is set.

Operation of cooking appliance 100 can be regulated by a controller (not shown) that is operatively coupled i.e., in communication with, user interface panel 112, lighting assembly 200, and heating sources 106, 108, 110. For example, in response to user manipulation of the knobs 114 of user interface panel 112, the controller operates one of heating source 108. Similarly, in response to user manipulation of the knobs 114 of user interface panel 112, the controller operates lighting assembly 200. By way of example, the controller may include a memory and one or more processing devices such as microprocessors, CPUs or the like, such as general or special purpose microprocessors operable to execute programming instructions or micro-control code associated with operation of appliance 100. The memory may represent random access memory such as DRAM, or read only memory such as ROM or FLASH. In one embodiment, the processor executes programming instructions stored in memory. The memory may be a separate component from the processor or may be included onboard within the processor.

The controller may be positioned in a variety of locations throughout appliance 100. In the illustrated embodiment, the controller may be located under or next to the user interface panel 112. In such an embodiment, input/output ("I/O") signals are routed between the controller and various operational components of appliance 100 such heating sources 106, 108, 110, controls 114, lighting assembly 200, sensors, graphical displays, and/or one or more alarms as will be further described. In one embodiment, the user interface panel 112 may represent a general purpose I/O ("GPIO") device or functional block.

Although shown with knobs 114, it should be understood that controls 114 and the configuration of appliance 100 shown in FIG. 1 is provided by way of example only. More specifically, user interface 112 may include various input components, such as one or more of a variety of touch-type controls, electrical, mechanical or electro-mechanical input devices including rotary dials, push buttons, and touch pads. The user interface 112 may include other display components, such as a digital or analog display device designed to provide operational feedback to a user. The user interface 112 may be in communication with the controller via one or more signal lines or shared communication busses. The user interface may be located on a different surface of the appliance, for instance, the angled front edge or the vertical backsplash.

FIGS. 2 and 3 illustrate cross-sectional views of cooking surface 104 of cook top 100 and particularly illustrates lighting assembly 200. As may be seen in FIGS. 2 and 3, cooking surface 104 has top 118 and a bottom 119. As discussed above, top 118 supports utensils during operation of cook top 100 via grates 116 (shown in FIG. 1). A reflector 220 is disposed on bottom 119 of cooking surface 104. Reflector 220 is configured for directing light L (FIG. 3) from a light source 240 (FIG. 3) through cooking surface 104.

Light source 240 is configured for selectively emitting light L. For example, light source 240 can emit light L during operation of any of heating sources 106, 108, 110. Light source 240 can include electron stimulated light sources, incandescent lamps (e.g., halogen lamps), electroluminescent lamps (e.g., light emitting diodes), gas discharge lamps, high intensity discharge lamps, or any other suitable source of light L or combinations thereof.

Reflector 220 has a first reflective panel 222 and a second reflective panel 224. First and second reflective panels 222, 224 extend from bottom 119 of cooking surface 104 with an angle between first and second reflective panels 222, 224. In FIGS. 2 and 3, the angle between first and second reflective panels 222, 224 is about sixty degrees. However, as will be understood by those skilled in the art, the optimum angle between the first and second panels 222, 224 is dependent on certain factors, e.g., the distance between light source 240 and bottom 119 of cooking surface 104 and the desired spread of light L at top 118 of cooking surface 104. Thus, the angle between first and second reflective panels 222, 224 may be any suitable angle. For example, the angle between first and second reflective panels 222, 224 may be between about ten degrees and about fifty degrees, between about ninety degrees and about thirty degrees, between about eighty degrees and about forty degrees, or between about seventy degrees and about fifty degrees.

As discussed above, reflector 220 is configured to redirect light L from light source 240. Thus, reflector 220 is constructed of reflective material. For example, reflector 220 may be constructed of aluminum. Specifically, reflector 220 may be constructed of horizontally brushed aluminum. However, in alternative embodiments, reflector 220 may be constructed of any suitable material or combination of materials. Also, in FIGS. 2 and 3, first and second reflective panels 222, 224 are substantially flat. However, in alternative embodiments, first and second reflective panels 222, 224 may have any suitable shape. For example, first and second reflective panels 222, 224 may be parabolic, elliptical, faceted, and/or any suitable combination thereof.

Cooking surface 104 has an opaque portion 210 and a transparent or translucent portion 212 (e.g., an aperture). Reflector 220 directs light L from light source 240 towards transparent or translucent portion 212 of cooking surface 104. Light L can pass though transparent or translucent portion 212. Thus, as shown in FIG. 3, light L directed towards transparent or translucent portion 212 travels through cooking surface 104 from bottom 119 to top 118 of cooking surface 104. Conversely, light L not directed towards transparent or translucent portion 212, either directly from light source 240 or via reflector 220, may not pass through cooking surface 104.

In certain embodiments, transparent or translucent portion 212 permits substantially the entire spectrum of light to travel through the cooking surface 104—i.e., transparent or translucent portion 212 is substantially transparent. However, in alternative embodiments, transparent or translucent portion 212 permits a limited range of the spectrum of light to travel through the cooking surface 104—i.e., transparent or translucent portion 212 is substantially translucent. For example, transparent or translucent portion 212 may include a filter for limiting the spectrum of light that passes through transparent or translucent portion 212. Thus, transparent or translucent portion 212 may permit only red light to pass through cooking surface 104 due to the filter and/or the material of cooking surface 104.

Opaque portion 210 can, e.g., absorb or reflect light L that is directed towards opaque portion 210. Thus, opaque portion 210 does not permit light L to pass through cooking surface 104. Accordingly, in general, while light L emitted directly towards transparent or translucent portion 212 or redirected towards transparent or translucent portion 212 via reflector 220 passes through cooking surface 104, light L directed towards opaque portion 210 does not pass though cooking surface 104.

In cooking surface 104, transparent or translucent portion 212 may be defined such that transparent or translucent portion 212 is constructed of the same material as cooking surface 104. For example, in FIGS. 2 and 3, cooking surface 104 is constructed of a ceramic pane, and opaque portion 210 and transparent or translucent portion 212 are constructed from the ceramic pane. Alternatively, cooking surface 104 may define an opening or hole for transparent or translucent portion 212. Thus, in the context of this application, the aperture is intended to include any construction or arrangement that permits light L to pass through cooking surface 104 and is not intended to be limited to holes or openings.

As may be seen in FIG. 3, first and second reflective panels 222, 224 direct light L from light source 240 towards transparent or translucent portion 212. Thus, as may be seen in FIG. 3, if reflector 220 is removed and does not redirect light L towards transparent or translucent portion 212, such light L would instead be directed towards opaque portion 210 and, as discussed above, not pass through cooking surface 104. Thus, reflector 220 increases the amount of light L that passes through cooking surface 104.

In addition, as may be seen in FIG. 3, light $L_R$ that is redirected by first and second reflective panels 222, 224 exits transparent or translucent portion 212 at a different angle than light $L_D$ that exits transparent or translucent portion 212 directly from light source 240. As may be seen in FIG. 3, if reflector 220 is removed and does not redirect light $L_R$ through transparent or translucent portion 212, only light $L_D$ emitted directly from light source 240 would be observable to a user. Thus, if reflector 220 is removed, the user must generally stand directly above transparent or translucent portion 212 in order to observe light L. Accordingly, reflector 220 increases the number of angles from which a user can observe light L from light source 240 by redirecting light L from beneath cooking surface 104.

In addition, it will be understood by those skilled in the art that if reflector 220 is positioned closer to light source 240, reflector 220 will direct a smaller range of light L towards transparent or translucent portion 212. By positioning reflector 220 adjacent bottom 119 of cooking surface 104, light L is permitted to diverge more before being reflected by reflector 220. Thus, by positioning reflector 220 adjacent bottom 119 of cooking surface 104, light $L_R$ directed by reflector 220 towards transparent or translucent portion 212 exits transparent or translucent portion 212 at a greater angle and/or with greater uniformity than would be possible if reflector 220 were positioned closer to light source 240.

As may be seen in FIGS. 2 and 3, first and second reflective panels 222, 224 are disposed such that reflector 220 substantially circumscribes transparent or translucent portion 212. Thus, reflector 220 is substantially linear in FIGS. 2 and 3 because transparent or translucent portion 212 is substantially linear. However, in alternative embodiments, transparent or translucent portion 212 may define any suitable shape in cooking surface 104. For example, transparent or translucent portion 212 may be substantially arcuate, circular, or ring-shaped. Accordingly, reflector 220 may have any suitable shape corresponding to transparent or translucent portion 212. However, it should be noted that, in alternative embodiments, reflector 220 need not circumscribe transparent or translucent portion 212 and may instead be positioned adjacent only a portion of transparent or translucent portion 212.

Referring again to FIG. 2, light assembly 200 may include a diffuser 230. Diffuser 230 scatters light L in order to change the angle that light L exits transparent or translucent portion 212. Thus, diffuser 230 assists reflector 220 in increasing the number of angles from which a user can observe light L from light source 240.

FIGS. 4 and 5 illustrate an alternative embodiment of light assembly 200. In FIGS. 4 and 5, a lens 300 directs light through transparent or translucent portion 212 rather than reflector 220 (FIG. 2). As may be seen in FIG. 5, lens 300 receives light L from light source 240. Light L entering lens 300 refracts, and, due to the curvature of lens 300, light L is directed towards transparent or translucent portion 212. It should be understood that, in additional alternative embodiments, lens 300 and reflector 220 may be used in combination to direct light L through transparent or translucent portion 212.

Lens 300 is a plano-convex lens with the flat surface of lens 300 positioned adjacent bottom 119 of cooking surface 104 such that lens 300 directs light L towards transparent or translucent portion 212. However, in alternative embodiments, lens 300 may have any suitable profile or shape, e.g., biconvex, biconcave, or plano-concave. Lens 300 has a low focal length, e.g., between about 5 and about 15 mm. However, in alternative embodiments, lens 300 may have any suitable focal length. Lens 300 may be constructed of glass, plastic, or any other suitable material.

Lens 300 may be constructed of a transparent material such that substantially the entire spectrum of light passes through lens 300. Alternatively, lens 300 may be constructed of a translucent material such that only a limited spectrum of light passes through lens 300. Lens 300 may be glued, strapped, or in any other suitable manner attached to bottom 119 of cooking surface 104.

In FIGS. 4 and 5, lens 300 is substantially linear. However, in alternative embodiments, lens 300 may be round or cylindrical in order to illuminate a circular or rectangular lighting pattern. Also, lens 300 may be molded to match a curved profile.

In FIGS. 4 and 5, lens 300 has a width that is substantially equal to a width of transparent or translucent portion 212. However, in alternative embodiments, lens 300 may have any suitable width. For example, lens 300 may be wider that transparent or translucent portion 212, or transparent or translucent portion 212 may be wider than lens 300.

It will be understood by those skilled in the art that, like reflector 220 in FIGS. 2 and 3, if lens 300 is positioned closer to light source 240, lens 300 will direct a smaller range of light L towards transparent or translucent portion 212. By positioning lens 300 adjacent bottom 119 of cooking surface 104, light L is permitted to diverge more before being refracted by lens 300. Thus, by positioning lens 300 adjacent bottom 119 of cooking surface 104, light L directed by lens 300 towards transparent or translucent portion 212 exits transparent or translucent portion 212 at a greater angle and/or with greater uniformity than would be possible if lens 300 were positioned closer to light source 240. In addition, it will be understood by those skilled in the art that if lens 300 is removed, a user must generally stand directly above transparent or translucent portion 212 in order to observe light L. Accordingly, lens 300 increases the number of angles from which a user can observe light L from light source 240 by redirecting light L from beneath cooking surface 104.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance comprising:

a heating source for applying a heat input to a cooking utensil;

a solid cooking surface configured for supporting the cooking utensil, said solid cooking surface having a top and bottom, said solid cooking surface including:

an opaque portion formed of said solid cooking surface; and a transparent or translucent portion formed of said solid cooking surface;

a light source positioned below the transparent or translucent portion of said solid cooking surface; and a reflector positioned on the bottom of said solid cooking surface above said light source, said reflector having a pair of reflective panels positioned opposite each other about the transparent or translucent portion of said solid cooking surface, each reflective panel of the pair of reflective panels positioned directly below the opaque portion of said solid cooking surface and extending away from the transparent or translucent portion of said solid cooking surface, the pair of reflective panels positioned and oriented such that the pair of reflective panels reflect light from said light source heading towards the opaque portion of said solid cooking surface towards the transparent or translucent portion of said solid cooking surface.

2. The cooktop appliance of claim 1, further comprising a diffuser positioned on the bottom of said solid cooking surface at the transparent or translucent portion of said solid cooking surface, said diffuser configured for scattering light entering the transparent or translucent portion of said solid cooking surface at the bottom of said solid cooking surface.

3. The cooktop appliance of claim 1, wherein light from said light source reflected by the pair of reflective panels exits the transparent or translucent portion of said solid cooking surface at a different angle than light that exits the transparent or translucent portion of said cooking surface directly from said light source.

4. The cooktop appliance of claim 1, wherein the pair of reflective panels extend from the bottom of said cooking surface with an angle between the reflective panels of the pair of reflective panels, the angle being between about ten degrees and about fifty degrees.

5. The cooktop appliance of claim 1, wherein each reflective panel of the pair of reflective panels is substantially flat.

6. The cooktop appliance of claim 1, wherein each reflective panel of the pair of reflective panels is substantially parabolic.

7. The cooktop appliance of claim 1, wherein said diffuser contacts each reflective panel of the pair of reflective panels.

8. The cooktop appliance of claim 1, wherein said light source is positioned directly below the transparent or translucent portion of said solid cooking surface such that said light source emits at least some light directly towards the transparent or translucent portion of said solid cooking surface.

9. The cooktop appliance of claim 1, wherein the reflective panels of the pair of reflective panels circumscribe the transparent or translucent portion of said solid cooking surface.

10. The cooktop appliance of claim 1, further comprising a grate positioned on the top of said solid cooking surface, wherein said heating source is a gas burner and said grate supports the cooking utensil above said heating source.

11. A cooktop appliance comprising:

a heating source for applying a heat input to a cooking utensil;

a ceramic cooking surface configured for supporting the cooking utensil, said ceramic cooking surface having a top and bottom, said ceramic cooking surface also having a transparent or translucent portion for permitting transmission of light through said ceramic cooking surface;

a light source positioned below the transparent or translucent portion of said ceramic cooking surface; and a reflector positioned on the bottom of said ceramic cooking surface above said light source, said reflector having a pair of reflective panels positioned opposite each other about the transparent or translucent portion of said ceramic cooking surface, each reflective panel of the air of reflective panels positioned directly below the opaque portion of said ceramic cooking surface and extending away from the transparent or translucent portion of said ceramic cooking surface, the pair of reflective panels positioned and oriented such that the pair of reflective panels reflect light from said light source heading towards the opaque portion of said ceramic cooking surface towards the transparent or translucent portion of said ceramic cooking surface.

12. The cooktop appliance of claim 11, wherein further comprising a diffuser positioned on the bottom of said ceramic cooking surface at the transparent or translucent portion of said ceramic cooking surface, said diffuser configured for scattering light entering the transparent or translucent portion of said ceramic cooking surface at the bottom of said ceramic cooking surface.

13. The cooktop appliance of claim 11, wherein light source reflected by the air of reflective panels exits the transparent or translucent portion of said ceramic cooking surface at a different angle than light that exits the transparent or translucent portion of said cooking surface directly from said light source.

14. The cooktop appliance of claim 11, wherein the pair of reflective panels extend from the bottom of said cooking surface with an angle between the reflective panels of the pair of reflective panels, the angle being between about ten degrees and about fifty degrees.

15. The cooktop appliance of claim 11, wherein each reflective panel of the pair of reflective panels is substantially flat.

16. The cooktop appliance of claim 11, wherein each reflective panel of the pair of reflective panels is substantially parabolic.

17. The cooktop appliance of claim 12, wherein said diffuser contacts each reflective panel of the pair of reflective panels.

18. The cooktop appliance of claim 11, wherein said light source is positioned directly below the transparent or translucent portion of said ceramic cooking surface such that said light source emits at least some light directly towards the transparent or translucent portion of said ceramic cooking surface.

19. The cooktop appliance of claim 11, wherein the reflective panels of the pair of reflective panels circumscribe the transparent or translucent portion of said ceramic cooking surface.

20. The cooktop appliance of claim 11, further comprising a grate positioned on the top of said cooking surface, wherein said heating source is a gas burner that extends through the cooking surface and said grate supports the cooking utensil above said heating source.

* * * * *